United States Patent [19]

Tauber

[11] Patent Number: 4,811,634

[45] Date of Patent: Mar. 14, 1989

[54] HAMMER HAT

[76] Inventor: Michael Tauber, 1908 S. Ashland Ave., Park Ridge, Ill. 60068

[21] Appl. No.: 80,861

[22] Filed: Aug. 3, 1987

[51] Int. Cl.[4] ..... B25C 1/00

[52] U.S. Cl. ..... 81/21

[58] Field of Search ..... 81/21, 44; 227/147, 227/149

[56] References Cited

U.S. PATENT DOCUMENTS

| | | | |
|---|---|---|---|
| 800,305 | 9/1905 | Kitson | 81/21 |
| 1,428,838 | 9/1922 | Davis . | |
| 1,718,161 | 6/1929 | Lutch . | |
| 2,765,827 | 10/1956 | Hall | 81/21 |
| 3,067,790 | 12/1962 | Tucker | 81/21 |
| 3,164,178 | 1/1965 | Belgard | 81/21 |
| 3,786,847 | 1/1974 | Schera, Jr. . | |

*Primary Examiner*—James G. Smith

*Attorney, Agent, or Firm*—Hill, Van Santen, Steadman & Simpson

[57] ABSTRACT

A guard which is mountable over the head of a hammer so as to stop fragments from flying which could injure the user. The guard is substantially larger than the hammer head and is formed with a large pocket which substantially encloses the head of the hammer so as to catch fragments which fly from the object being striked by the hammer to prevent injury to the user or anyone in the immediate area. The guard is flexible so that it will collapse and has a memory so that it will return to its original position. The guard may be made of clear plastic so that the object being striked by the hammer is visible through the guard. Various structures and methods of mounting the guard to the hammerhead are provided.

5 Claims, 2 Drawing Sheets

HAMMER HAT

BACKGROUND OF THE INVENTION

1. Field of the Invention

This invention relates in general to a guard for hammers and particularly to an improved guard which prevents injury to the user or anyone in the immediate area.

2. Description of the Prior Art

The following U.S. Patents disclose attachments to the hammer for preventing marring of the work surface. U.S. Pat. Nos. 800,305, 3,067,780, 1,718,161, 1,428,838, 3,164,178 and 3,786,847. All of these patents with the exception of U.S. Pat. No. 3,786,847 provide a small protective sleeve on the head of the hammer such that when a nail or other object is struck, the head of the hammer will not strike and mar the workpiece. U.S. Pat. No. 3,786,847 comprises a safety sledge hammer formed with a truncated conical opening which assists in striking a metal stake.

SUMMARY OF THE INVENTION

The present invention relates to a protective guard which is mounted on the head of the hammer and forms a pocket of substantial size capable of catching and intercepting broken particles flying from the workpiece as the hammer strikes the workpiece. The flexible guard has a memory and returns to its original position after each impact and may also be made of transparent plastic so that the workpiece can be clearly observed as the hammer is used Different structural arrangements are provided for attaching the guard to the head of the hammer.

Other objects, features and advantages of the invention will be readily apparent from the following description and claims when read in view of the drawings in which.

DESCRIPTION OF THE PREFERRED EMBODIMENTS

Figure 1:
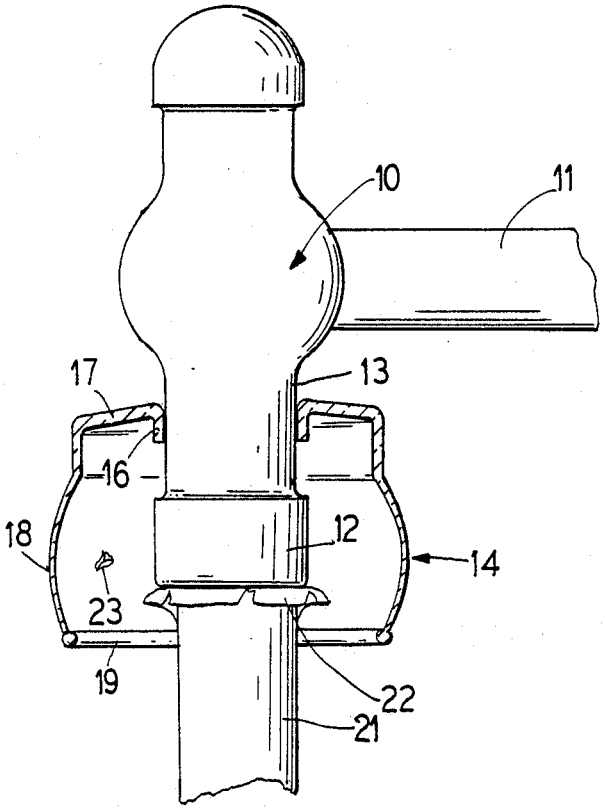
FIG. 1 is a side sectional view of a first embodiments of the guard.
Figure 2:
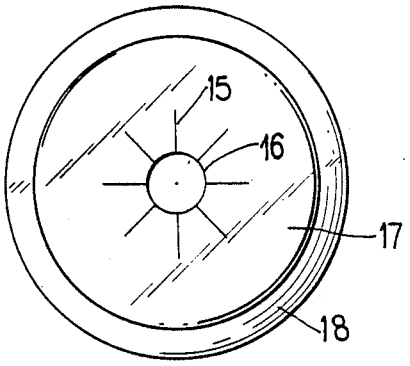
FIG. 2 is a top plan view of the guard of FIG. 1.

FIGS. 1 and 2 illustrate the first embodiment of the hammer guard according to the invention. A hammer 10 has a handle 11 and a striking end 12 which is attached to the main portion of the hammer by a portion 13 of reduced cross sectional dimension.

The guard 14 of the invention is formed of flexible plastic and as shown in FIGS. 1 and 2 has a top portion 17 which is formed with radial slots 15 and an inner opening 16 through which the head 12 of the hammer can be inserted so that the extending ends 16 of the guard will bear against the reduced cross sectional portion 13 of the hammer to hold the guard 14 in place. The guard has generally curved sidewalls 18 which extend from the top portion 17 to a lower annular rib 19 which extends beyond the end of the hammerhead 12.

In operation, the hammer 10 is used to hit a workpiece such as a rod 21 such that upon impact, the head 12 makes contact with the workpiece within the confines of the guard 14 as shown in FIG. 1. If burrs 22 are formed on the workpiece 21, they are capable of being broken off by the hammer so that the fragments 23 fly outwardly from the workpiece as it is struck and without the guard 14 could injure the user of the hammer or anyone in the immediate area. As shown in FIG. 1, a fragment 23 which has broken loose from the head of the workpiece 21 will be intercepted by the guard 14 so that it cannot injure the user of the hammer or anyone in the immediate area.

Figure 3:
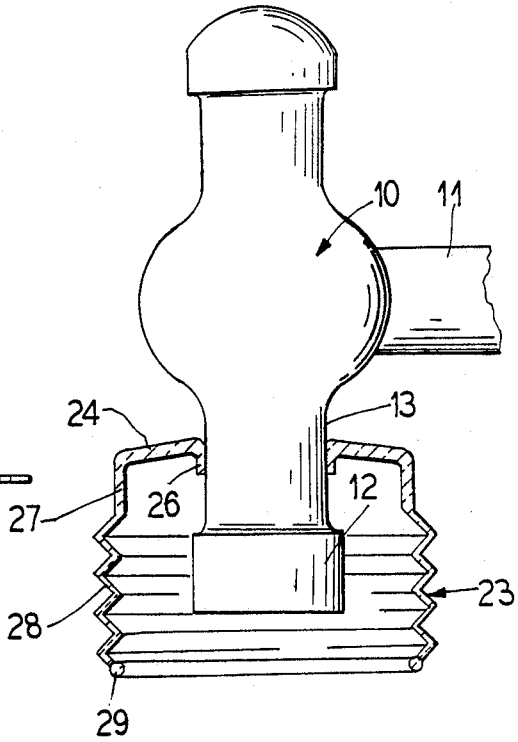
FIG. 3 illustrates a modified form of the guard.

FIG. 3 illustrates a modification of the guard wherein the guard 23 is formed with a top 24 and downwardly extending portions 26 which grip the reduced cross-sectional portion 13 of the hammer. A downwardly extending portion 27 is attached to the top 24 and bellow-shaped portion 28 extends from the portion 27 to an annular lower ring 29. As the workpiece 21 is struck, fragments will be captured within the guard 23 and the bellows 28 facilitate collapsing of the guard if the ring 29 engages a work surface.

Figure 4:
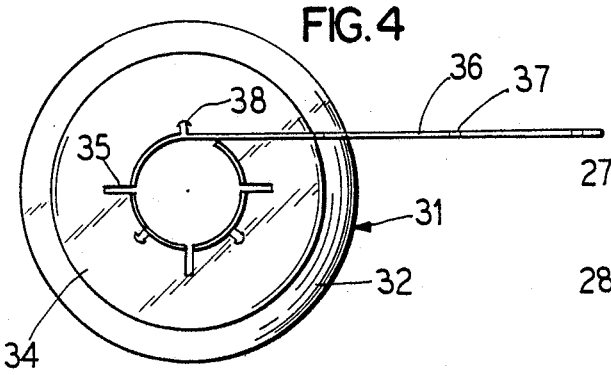
FIG. 4 is a top plan view of modified form of the guard.
Figure 5:
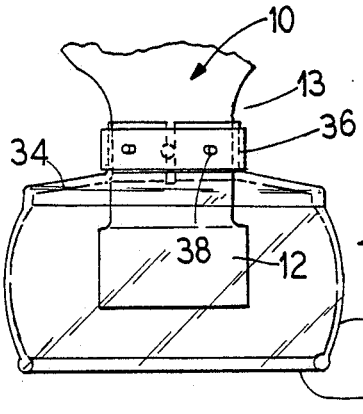
FIG. 5 is a side sectional view of the guard illustrated in FIG. 4.

FIGS. 4 and 5 illustrate another embodiment of the invention wherein a guard 31 has downwardly extending portions 32 and a lower annular member 33. The top 34 of the guard 31 is formed with a central opening which has slots 35 and a flexible band 36 is formed with a plurality of openings 37 which are receivable on extending headed pins 38 when the head of the hammer is inserted through the guard. The band 36 after being wrapped around the portion of smaller diameter 13 can be attached to the headed pins 38 as shown in FIG. 5 to lock the guard onto the head of the hammer.

Figure 6:
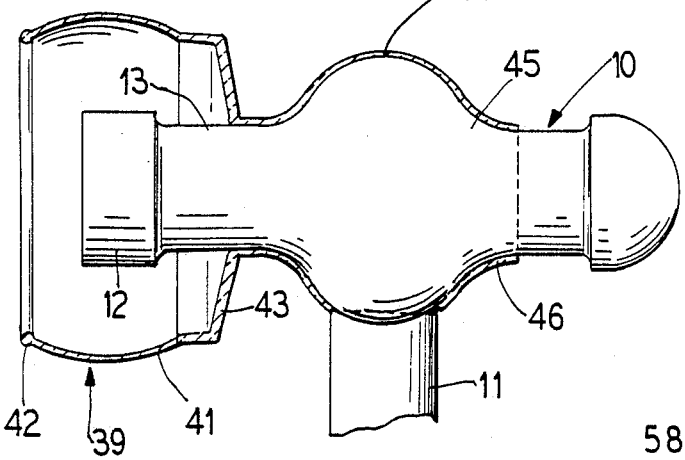
FIG. 6 illustrates a modification of the guard of the invention.
Figure 7:
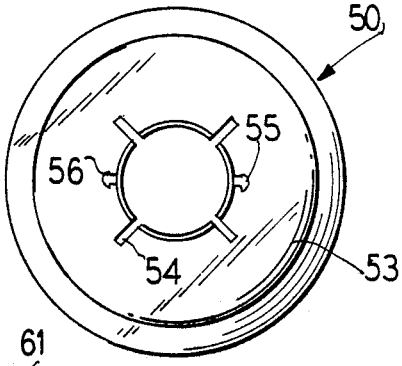
FIG. 7 is a top plan view of a modification of the invention.

FIG. 6 illustrates another embodiment of the invention where the guard 39 has a downwardly extending sidewalls and an annular portion 42 and a top 43 and wherein the top 43 and the guard is molded around the hammer such that extensions 44 and 46 extend over the enlarged portion 45 of the hammer adjacent the handle and terminate in a decreased diameter portion 46 on the side of the hammer opposite the head 12.

Figure 8:
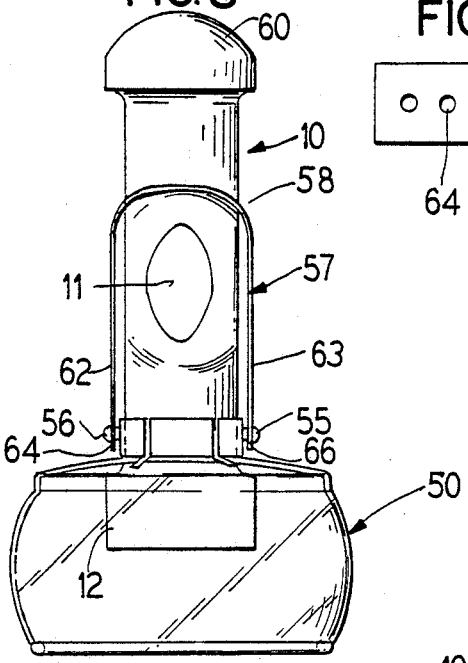
FIG. 8 is a front sectional view of the modified form of the invention in FIG. 7.
Figure 9:
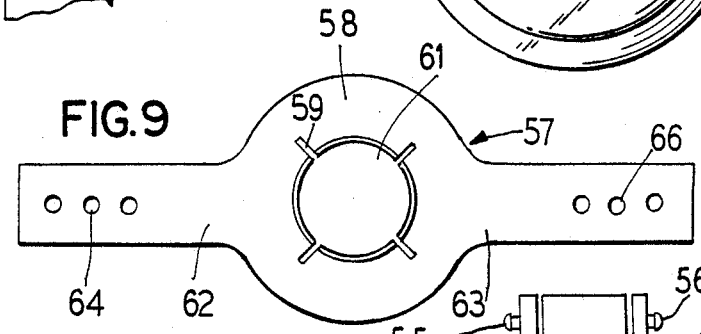
FIG. 9 is a plan view of the holding means of the modification illustrated in FIG. 8.
Figure 10:
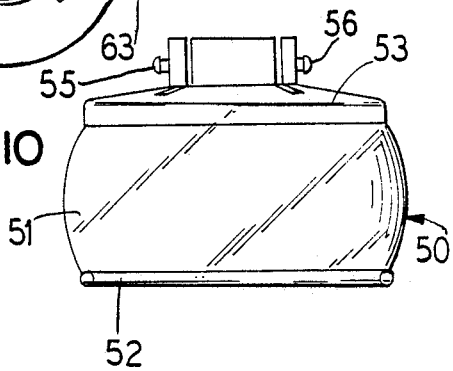
FIG. 10 is a side plan view of the guard of FIG. 8.

FIGS. 7, 8, 9 and 10 illustrate another embodiment of the invention wherein the guard 50 has downwardly extending sides 51 and a lower annular edge 52 and a top 53. A shown in FIG. 7, the top 53 is formed with spaced grooves 54 around a central opening through which the head 12 of the hammer can be inserted and headed pins 55 and 56 extend from the guard 50. A holding strap 57 shown in FIG. 9 has a central opening 61 formed with slots 59 and can be mounted over the second end 60 of the hammer as shown in FIG. 8 and downwardly extending portions 62 and 63 are formed with openings 64 and 66 which can be respectively attached to the headed pins 55 and 56 as shown in FIG. 8 so as to hold the guard 50 firmly onto the hammer.

Figure 11:
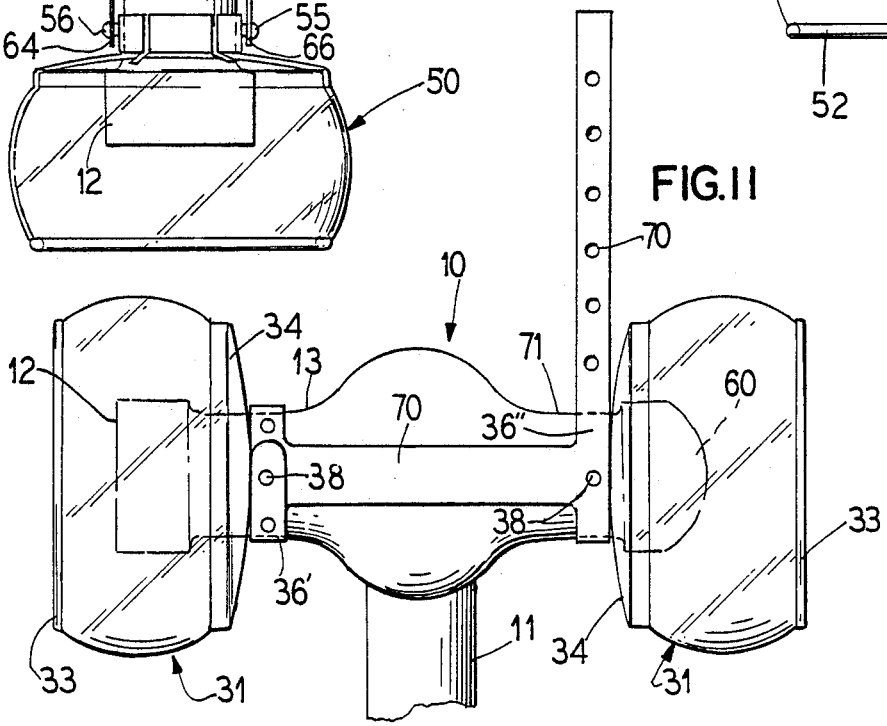
FIG. 11 illustrates a modified form of the guard.

FIG. 11 illustrates another embodiment of the invention where a pair of guards 31 are mounted on the ends 12 and 60 of the hammer. The guards 31 have tops 34 and bottom annular portions 33 and are formed with upwardly extending collars from which headed pins 38 extend. A strap 70 is formed with strips 36′ and 36″ in which openings 70 are formed such that they can be wrapped around the reduced cross section portions 13 and 71 of the hammer 10 so as to lock the guards 31 and 31 on to the heads of the hammer by extending the headed pins 38 through the opening 70 in the strips 36' and 36''.

It is seen that the invention provides a novel protective guard for a hammer which prevents fragments from injurying the user or anyone in the immediate area and although it has been described with respect to preferred embodiments, it is not to be so limited as changes and modifications may be made therein which are within the full intended scope as defined by the appended claims.

I claim:

1. A protective guard for a hammer comprising, a cup-shaped member which is larger than the head of the hammer and which is formed with a top member formed with an opening through which the head of the hammer can be inserted and downwardly extending flexible sidewalls which extend beyond the end of the head of the hammer so as to form a fragment catching pocket for fragments which fly from a workpiece as it is struck by said hammer, and wherein a collar is formed around said opening from which pins extend and a flexible strip attached to said collar and wrapable around the shank of hammer and formed with openings through which said pins can be inserted to lock said guard to said hammer.

2. A protective guard for a hammer comprising,a cup-shaped member which is larger than the head of the hammer and which is formed with a top member formed with an opening through which the head of the hammer can be inserted and downwardly extending flexible sidewalls which extend beyond the end of the head of the hammer so as to form a fragment catching pocket for fragments which fly from a workpiece as it is struck by said hammer, and wherein said guard is molded to said hammer and holding portions extend from said top member to hold said guard to said hammer.

3. A protective guard for a hammer comprising,a cup-shaped member which is larger than the head of the hammer and which is formed with a top member formed with an opening through which the head of the hammer can be inserted and downwardly extending flexible sidewalls which extend beyond the end of the head of the hammer so as to form a fragment catching pocket for fragments which fly from a workpiece as it is struck by said hammer, and including a strap formed with a first opening through which a second end of the hammer can be inserted, pins with enlarged heads extending on opposite sides of said top member adjacent its opening, and said flexible strap formed with other openings through which said pins with enlarged heads can be received to hold said guard to said hammer.

4. A protective guard for a hammer comprising, a cup-shaped member which is larger than the head of the hammer and which is formed with a top member formed with an opening through which the head of the hammer can be inserted and downwardly extending flexible sidewalls which extend beyond the end of the head of the hammer so as to form a fragment catching pocket for fragments which fly from a workpiece as it is struck by said hammer, and mounted on one end of said hammer and a second guard of the same shape mounted on the second end of said hammer, and fastening means extending between said guards to lock them to said hammer.

5. A guard according to claim 4 wherein said fastening means is a flexible strip which can be attached to said guards.

* * * * *